US011828137B2

(12) United States Patent
Oksman et al.

(10) Patent No.: US 11,828,137 B2
(45) Date of Patent: Nov. 28, 2023

(54) BREAKING HAMMER AND METHOD OF SUPPORTING PERCUSSION PISTON

(71) Applicant: SANDVIK MINING AND CONSTRUCTION OY, Tampere (FI)

(72) Inventors: Mika Oksman, Tampere (FI); Jyrki Nissinen, Tampere (FI); Juhani Laine, Tampere (FI); Harri Moilanen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 3 days.

(21) Appl. No.: 17/668,870

(22) Filed: Feb. 10, 2022

(65) Prior Publication Data

US 2022/0251904 A1 Aug. 11, 2022

(51) Int. Cl.

| | |
|---|---|
| ***E21B 4/14*** | (2006.01) |
| ***B25D 9/12*** | (2006.01) |
| ***B25D 9/18*** | (2006.01) |
| ***E02D 7/10*** | (2006.01) |

(52) U.S. Cl.

CPC ..... *E21B 4/14* (2013.01); *B25D 9/12* (2013.01); *B25D 9/18* (2013.01); *E02D 7/10* (2013.01); *B25D 2250/065* (2013.01); *B25D 2250/105* (2013.01); *B25D 2250/121* (2013.01); *B25D 2250/231* (2013.01)

(58) Field of Classification Search

CPC .... E21B 4/14; B25D 9/12; B25D 9/18; B25D 2250/065; B25D 2250/105; B25D 2250/121; B25D 2250/231; E02D 7/10

See application file for complete search history.

(56) References Cited

U.S. PATENT DOCUMENTS

| | | | | |
|---|---|---|---|---|
| 3,955,478 | A | 5/1976 | Feucht | |
| 10,493,610 | B2 * | 12/2019 | Koizumi | B25D 9/12 |
| 2015/0129269 | A1 * | 5/2015 | Muuttonen | E21B 1/04 173/206 |
| 2015/0197988 | A1 | 7/2015 | Lee | |

* cited by examiner

*Primary Examiner* — Anna K Kinsaul
*Assistant Examiner* — Veronica Martin
(74) *Attorney, Agent, or Firm* — Corinne R. Gorski

(57) ABSTRACT

A hydraulic breaking hammer and method of supporting a percussion piston is provided. The breaking hammer includes a percussion device provided with a reciprocating piston. The piston is supported on a frame at its end portions by a first piston bearing element and a second piston bearing element. The second piston bearing element includes a collar sealing element facing towards a working collar of the piston. The piston bearing elements are easily mountable and dismountable separate components.

10 Claims, 4 Drawing Sheets

BREAKING HAMMER AND METHOD OF SUPPORTING PERCUSSION PISTON

RELATED APPLICATION DATA

This application claims priority under 35 U.S.C. § 119 to EP21156643.5, filed on Feb. 11, 2021, which the entirety thereof is incorporated herein by reference.

TECHNICAL FIELD

The present disclosure relates to a hydraulic breaking hammer. The breaking hammer includes a percussion device provided with a percussion piston supported axially movably inside a frame of the percussion device by means of bearings. The disclosure further relates to a method of supporting a piston of a percussion device of a hydraulic breaking hammer.

BACKGROUND

Breaking hammers are used to break hard materials, such as rock, concrete, and the like. The breaking hammer includes a percussion device for generating impact pulses to a breaking tool connectable to the breaking hammer. The percussion device includes a piston which is arranged axially movably inside a frame of the percussion device. The piston is supported by means of bearings in relation to a frame of the percussion device. Known bearing solutions have shown some drawbacks.

SUMMARY

An object of the invention is to provide a novel and improved breaking hammer and a method of supporting a percussion piston.

The breaking hammer according to the invention includes a percussion device including a frame and a piston arranged inside the frame, the percussion device being configured to perform a working cycle including reciprocating longitudinal movement of the piston in an impact direction and a return direction due to pressure of hydraulic fluid fed to first and second working pressure spaces of the percussion device; at least one control device is arranged for controlling feeding and discharging of the hydraulic fluid of at least one of the first and second pressure spaces for executing the working cycle; a working collar of the piston is located between the first and second working pressure spaces and wherein an outer surface of the working collar is sealed to surrounding structures so that the first and second working pressure spaces are hydraulically separated; and a first piston bearing and a second piston bearing located at an axial distance from each other, wherein the first and second piston bearings are configured to provide support for the opposite first and second end portions of the piston, whereby the first working pressure space, the working collar and the second working pressure space are all located between the first and second piston bearings, at least the second piston bearing being a separate sleeve-like element mountable to the frame in one piece, wherein a radial clearance is disposed between the outer surface of working collar and the second piston bearing element, at least one separate collar sealing element being arranged to seal the clearance, and wherein the second piston bearing element includes at least one first sealing housing for the collar sealing element.

The present method of supporting a piston of a hydraulic breaking hammer includes supporting the piston axially movably relative to a frame of a percussion device of the breaking hammer by means of a first piston bearing and a second piston bearing; sealing working pressure spaces of the percussion device from each other by means of a sealing element, which is located at a working collar of the piston; arranging the first piston bearing at an impact direction side end portion of the piston and the second piston bearing at an opposite returning direction side end portion of the piston; using a separate sleeve-like bearing bushing at least for the second piston bearing element; providing the second piston sealing bushing with a first sealing housing facing towards the piston; mounting a changeable collar sealing element to the first sealing housing; and mounting the second piston bearing bushing together in one piece with the collar sealing element to the frame of the percussion device, wherein the second piston bearing element provides bearing and sealing for the piston.

An idea of the disclosed solution is that a piston of a percussion device is supported at its distal end portions by means of bearings and at middle section of the piston is a working collar for providing the piston with working pressure surfaces for moving the piston in impact direction and return direction. In the return direction end, there is a sleeve-like second piston bearing element. This element or bushing is a separate piece mountable to a frame of the percussion device in one piece. The second bearing element is a dual-purpose element providing not only bearing but also sealing for the piston. For the sealing the second piston bearing element is provided with a sealing housing for receiving a collar sealing element. The collar sealing element seals a radial clearance between a radial outer surface of the working collar and an inner surface of the second piston bearing element. The collar sealing element is a changeable component.

An advantage of the disclosed solution is that the separate second piston bearing element is easy and quick to mount and dismount in one piece inside the frame of the percussion device. Further, when the piston bearings are located at the distal end portions of the piston, the piston is well supported. The disclosed structure may also allow total length of the percussion piston and the entire percussion device to be shortened, which has a positive impact to handling and weight of the breaking hammer.

According to an embodiment, the sealing housing is located at a tool side end portion of the second bearing element and includes a sealing groove on an inner surface of the second bearing element. The collar sealing element is a slide ring mounted to the sealing groove. Replacing of the sealing ring is easy when the second bearing element is at first removed from the frame.

According to an embodiment, the slide ring is a made of plastic material having good slide bearing properties.

According to an embodiment, the second piston bearing element is provided with a dedicated lubrication channel.

According to an embodiment, hydraulic fluid is fed via the lubrication channel towards the second bearings continuously during the working cycle. The lubrication channel may be connected to a high pressure accumulator, for example. The lubricant may lubricate and cool the bearing. Proper lubrication of the bearing prevents seizure of the percussion device in hard conditions and usage.

According to an embodiment, the second bearing element is provided with a dedicated tank channel provided with a throttling and being in connection to a tank. The tank channel may discharge pressure to a tank from an area between seals and may also provide lubrication for the seals.

According to an embodiment, the second piston bearing element is provided with an end cushion space. The end cushion space forms a closed pressure space together with the working collar when the piston movement in the return direction exceeds a predetermined dead point where the movement of the piston changes between the return and impact direction movements. In other words, the second piston bearing element or bushing, which is located at the return side end of the percussion device, may be a triple-purpose element providing the piston with bearing, sealing and deceleration.

According to an embodiment, the first and second piston bearings are both replaceable and elongated bearing bushings.

According to an embodiment, the bearing bushings are made of tempered steel. Alternatively, the bearing bushings may be made of other metallic materials such as bronze or cast iron.

According to an embodiment, the first bearing bushing includes at least one sealing housing provided with at least one sealing facing towards the piston. Thus, the first bearing bushing, which is located at the impact side end of the percussion device is also easily replaceable component which facilitates maintenance.

According to an embodiment, the percussion device includes a direct acting pressure accumulator which is located at a return direction end of the piston and is configured to store pressure energy when the second end of the piston protrudes inside the accumulator during its movement in the return direction. The second sealing housing is provided with a gas sealing element facing towards the piston and separating a bearing portion of the second piston bearing element and the pressure accumulator fluid tightly from each other. The second piston bearing element is provided with a second sealing housing at its second end portion facing towards the pressure accumulator and being capable of receiving the gas seal. In other words, the second piston bearing element or bushing which is located at the return side end of the percussion device is a quadruple-purpose element providing the piston with bearing, hydraulic sealing, deceleration and gas sealing.

According to an embodiment the second working pressure space, which is located at the return direction side, is limited only by the piston and the second piston bearing element. In other words, the second piston bearing element or bushing which is located at the return side end of the percussion device is a quintuple-purpose element providing the piston with bearing, hydraulic sealing, deceleration, gas sealing and limiting the second working pressure space.

According to an embodiment, the first and second piston bearings are both replaceable and elongated bearing bushings. Magnitudes of outer diameters of the bushings facing radially to the frame are equal. Further, the frame of the percussion device includes a central through opening and at least both end portions of the central through opening have coaxial inner diameters magnitude of which are equal and match with the equal outer diameter of the bearing bushings. The inner diameters of both end portions of the frame can be machined accurately in one machine utilizing one fastening thereby ensuring that support surfaces for the bearings are coaxial.

According to an embodiment, the frame of the percussion device includes a middle portion between the end portions, and wherein an inner diameter of the middle portion is equal with the diameters of the end portions. In other words, there are three inner diameters with the same diameter. This simplifies structures of the piston bearing elements and facilitates machining work of the frame.

According to an embodiment, all the machined inner diameters of the through opening of the frame of the percussion device are coaxial and have the same magnitude of diameter. This kind of structure is beneficial for easy manufacture.

According to an embodiment, the control device is configured to direct substantially constant hydraulic fluid pressure to a first working pressure space for moving the piston in the return direction and is configured to feed and discharge hydraulic fluid pressure to and from the second working pressure space and to thereby control reciprocating movement of the piston during the work cycle. In other words, the percussion device includes an alternating pressure conditions (high pressure tank pressure) in the impact direction side of the piston.

According to an embodiment, an operational principle of the percussion device differs from the one disclosed in the previous embodiment above. The percussion device may alternatively have alternating high pressure tank pressure conditions effecting in the return direction movement of the piston, and substantially constant high pressure conditions pushing the piston in the impact direction. A further alternative is a solution wherein alternating pressure conditions high pressure tank pressure is controlled during the work cycle in both movement directions. Also, in these disclosed alternative solutions, it is possible to utilize the piston bearing and sealing solutions, as well as other features, disclosed in this document.

According to an embodiment, the solution relates to a method of supporting a piston of a hydraulic breaking hammer. The method includes: supporting the piston axially movably relative to a frame of a percussion device of the breaking hammer by means of a first piston bearing and a second piston bearing; and sealing working pressure spaces of the percussion device from each other by means of a sealing element which is located at a working collar of the piston. The method further includes: arranging the first piston bearing at a tool side end portion of the piston and the second piston bearing at an opposite returning side end portion of the piston; using a separate sleeve-like bearing bushing at least for the second piston bearing element; providing the mentioned second piston sealing bushing with a first sealing housing facing towards the piston; mounting a changeable collar sealing element to the first sealing housing; and mounting the second piston bearing bushing together in one piece with the collar sealing element to the frame of the percussion device wherein the second piston bearing element provides bearing and sealing for the piston.

According to an embodiment, the method includes: providing the percussion device with a tube-like frame comprising a through opening wherein both ends comprise coaxial and equally sized inner diameters. Separate first piston bearing bushing and second piston bearing bushing are pushed in axial direction to the ends of the through opening. All sealings of the piston bearing bushings are mounted and dismounted when the bushings are dismounted from the frame whereby maintenance and repair work is facilitated.

The above-disclosed embodiments can be combined to form desired solutions provided with necessary features disclosed.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

For the sake of clarity, the figures show some embodiments of the disclosed solution in a simplified manner. In the figures, like reference numerals identify like elements.

DETAILED DESCRIPTION

Figure 1:
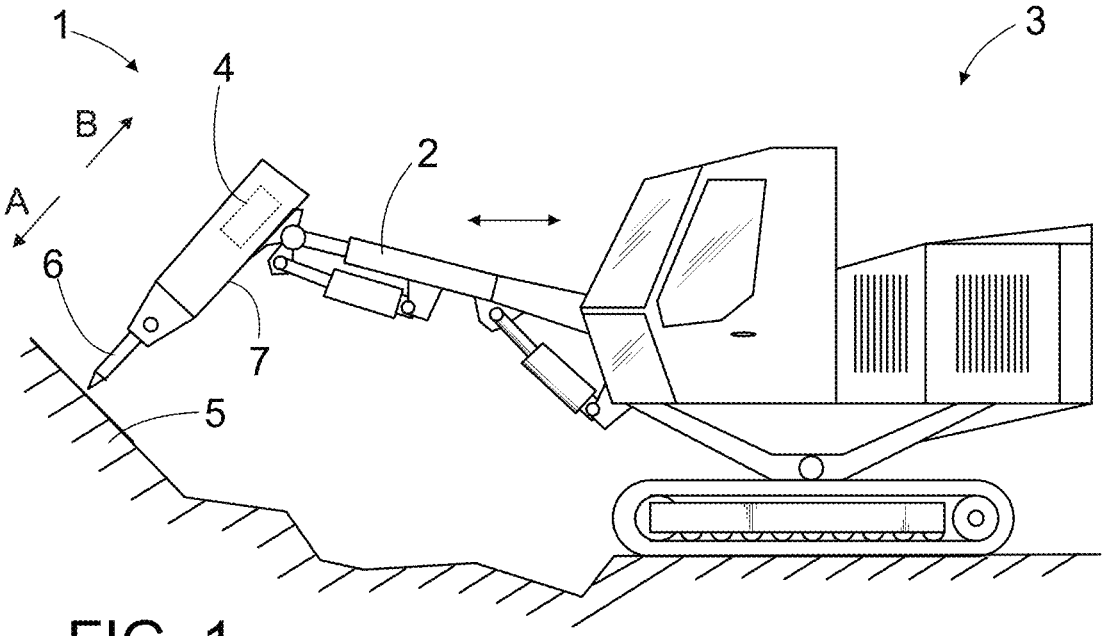
FIG. 1 is a schematic side view of an excavator, which is provided with a breaking hammer.

FIG. 1 shows a breaking hammer 1 arranged on a free end of a boom 2 of a working machine 3, such as an excavator. Alternatively, the boom 2 may be arranged on any movable carriage or on a fixed platform of a crushing apparatus, for example. The breaking hammer 1 includes a percussion device 4 for generating impact pulses. The breaking hammer 1 may be pressed by means of the boom 2 against material 5 to be broken and impacts may be simultaneously generated with the percussion device 4 to a tool 6 connected to the breaking hammer 1. The tool 6 transmits the impact pulses to the material 5 to be broken. The percussion device 4 is hydraulic, whereby it is connected to a hydraulic system of the working machine 2.

The impact pulses are generated in the percussion device 4 by means of a percussion piston, that is moved back and forth in the impact direction A and return direction B under the influence of hydraulic fluid. Further, the breaking hammer 1 may have a protective casing 7, inside which the percussion device 4 may be located. The percussion device 4 may be in accordance with the solution disclosed herein.

Figure 2:
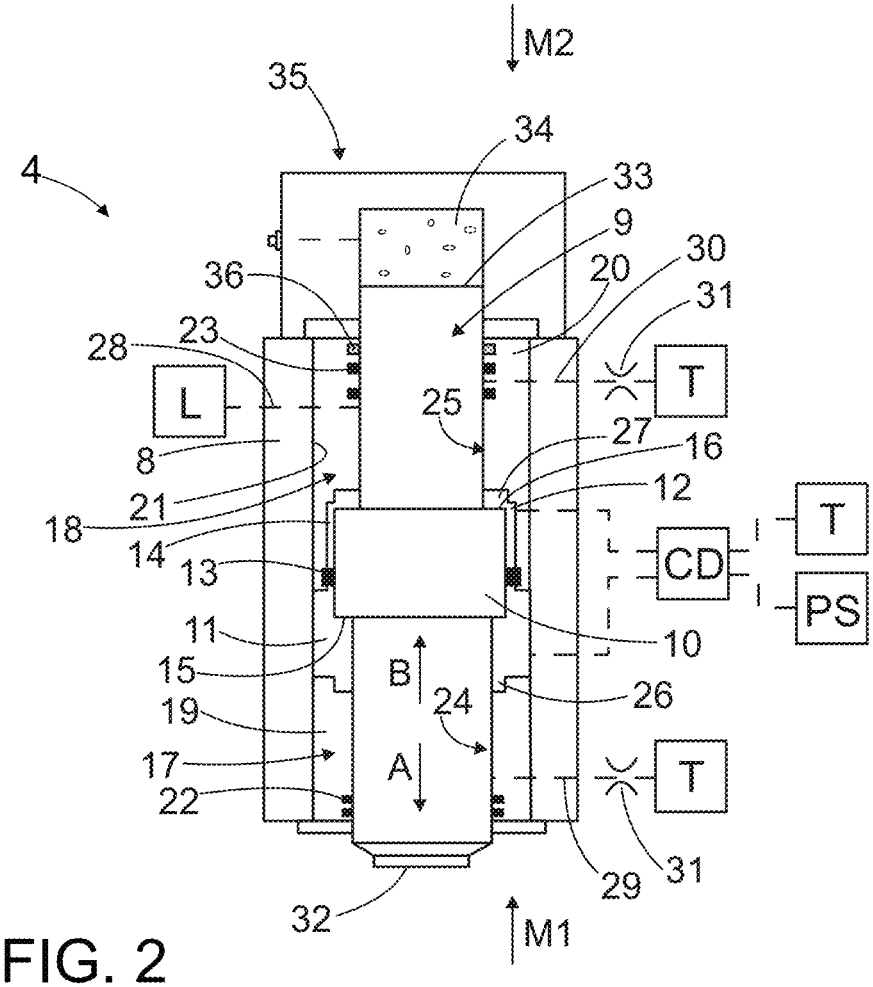
FIG. 2 is a schematic and sectional side view of a hydraulically operated percussion device of a breaking hammer.

FIG. 2 discloses a basic structure of a percussion device 4 of a breaking hammer. The percussion device 4 includes a frame 8 inside which is a percussion piston 9 arranged to be moved in an impact direction A and return direction B. The piston 9 includes a working collar 10 at its middle section. At the impact direction A side of the collar 10 there is a first working pressure space 11 and at a return direction B side there is a second working pressure space 12 inside which pressure of hydraulic fluid is controlled by means of a control device CD. The working pressure spaces 11, 12 are separated from each other by means of a collar sealing element 13. A clearance 14 or annular gap surrounds the working collar 10 and this clearance 14 is sealed by the collar sealing element 13.

The piston 9 includes a first working pressure surface 15 for moving the piston 9 in the return direction B, and a second working pressure surface 16 for moving the piston 9 in the impact direction A. The control device CD may alternate pressure in the second working pressure space 12 by connecting the second pressure space to a tank T or to a pressure source PS. The control device CD may connect the first working pressure space 11 to the pressure source for the duration of the working cycle. Since effective area of the second working pressure surface 16 is larger than the one of the first working pressure surface 15, the piston moves in the impact direction A when high pressure is fed to the second working pressure space 12. It should be appreciated that the control of the pressure flows, and the effective areas of the working pressure surfaces may also be arranged and dimensioned in other ways.

The percussion piston 9 is supported to the frame 8 by a first piston bearing 17 and a second piston bearing 18. The first and second piston bearings 17, 18 are separate sleeve-like piston bearing elements 19, 20 which can be mounted axially inside a central through opening 21 of the frame 8. The first piston bearing element 19 provides support for the piston 9 at a lower end portion of the percussion device 4, and the second piston bearing element 20 provides support at the upper end portion. The piston bearing elements 19, 20 or bushings are provided with one or more hydraulic seals 22, 23 for sealing an inner opening diameter of the piston bearings elements 19, 20 to outer diameters of the piston 9. In addition to these seals and a sealing section, the piston bearing elements 19, 20 have bearing portions 24, 25 for providing slide bearing for the opposite end portions of the piston 9. The piston bearing elements 19, 20 may also include end cushion spaces 26, 27 forming closed pressure spaces with the working pressure surfaces 15, 16 if the piston exceeds its normal stroke lengths in the impact direction A and return direction B. As can be seen, the second working pressure space 12 may be defined between the piston 9 and the second piston bearing element 20. The bearing portion 25 of the second bearing element 20 may be provided with a dedicated lubrication channel 28 for providing lubrication from a lubrication source L for the slide bearing surfaces. Both piston bearing elements 19, 20 may comprise dedicated tank channels 29, 30 provided with throttling devices 31 and connected to the tank T.

The percussion piston 9 includes an impact surface 32 facing towards the impact direction A and configured to strike a tool. A rear surface 33 of the piston 9 is facing towards the return direction B and is configured to move inside a gas space 34 of a direct acting pressure accumulator 35. At an end portion of a sealing section of the second piston element 20 there is a gas sealing element 36 for separating the bearing portion 25 and the gas space 34 fluid tightly from each other.

The control device CD may be a control valve, control valve assembly, or a set of directly or indirectly controlled valve elements, for example. The control device CD may comprise one or more control elements moving in linear or rotational control path and controlling one or more pressure channels of control pressure channels.

FIG. 2 further discloses axial mounting directions M1 and M2 of the piston bearing elements 19, 20 inside the through opening 21 of the frame 8.

Figure 3:
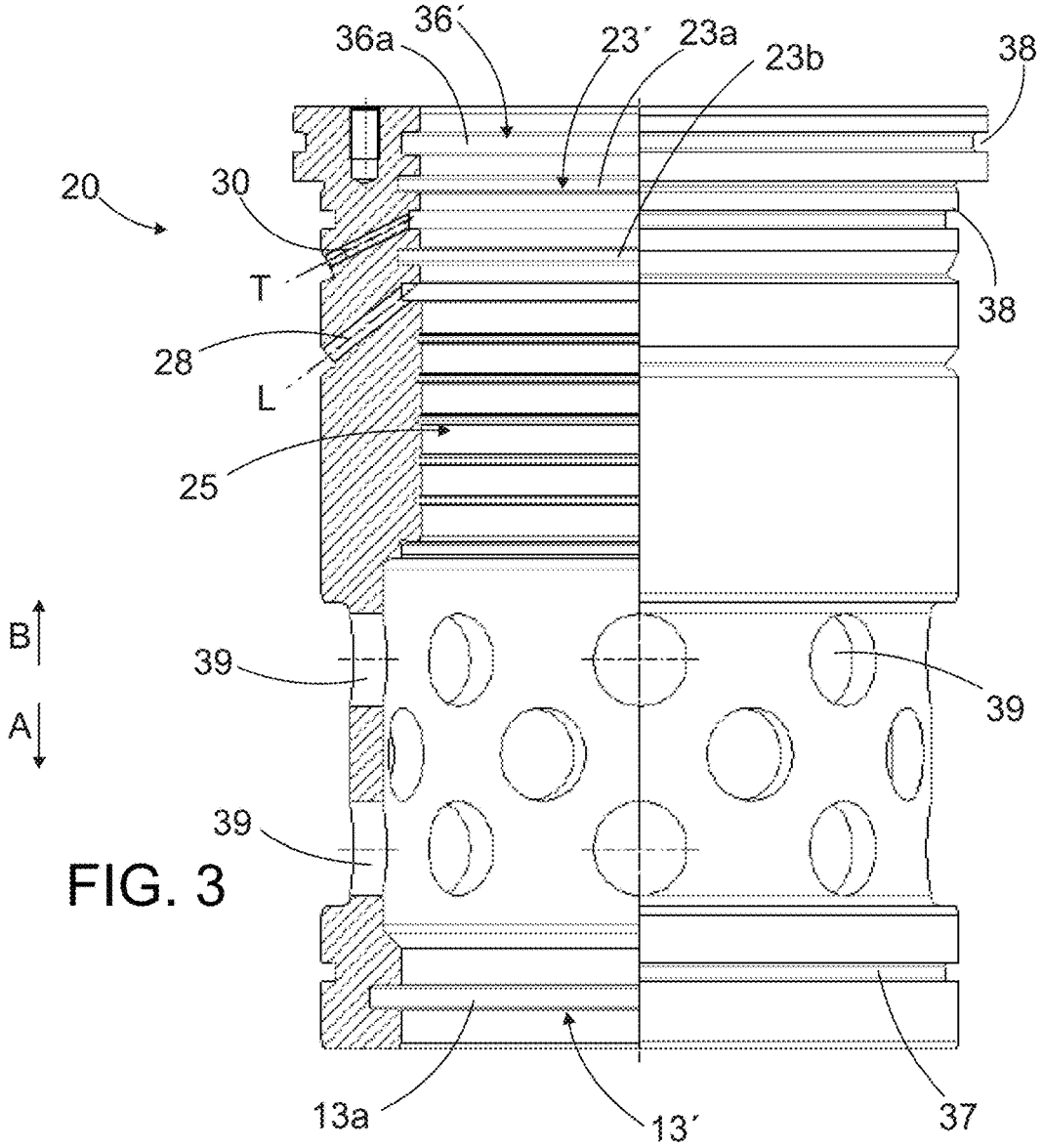
FIG. 3 is a schematic and partly sectional side view of a second piston bearing bushing mountable at a reverse direction side end of a percussion device.
Figure 4:
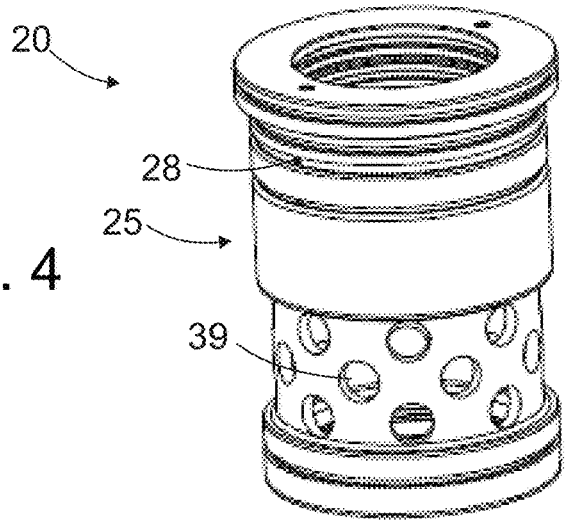
FIG. 4 is a schematic view of the second piston bearing bushing of FIG. 3.

FIGS. 3 and 4 disclose a second piston bearing element 20 which is substantially in accordance with the one shown in FIG. 2. FIG. 3 further shows sealing housings 23' for receiving the hydraulic sealing elements. The sealing housings 23' may be grooves 23*a*, 23*b*. A sealing housing 36' for the gas sealing element may be a sealing groove 36*a*. A sealing housing 13' for receiving the working collar sealing element may be a sealing groove 13*a*. Further, on outer surfaces of both end portions of the second piston bearing sleeve 20 there may be sealing grooves 37, 38 for receiving outer sealing elements facing towards the longitudinal through opening of the frame. The bushing 20 may have several transverse openings 39 for feeding hydraulic fluid through the sleeve-like construction.

Figure 5:
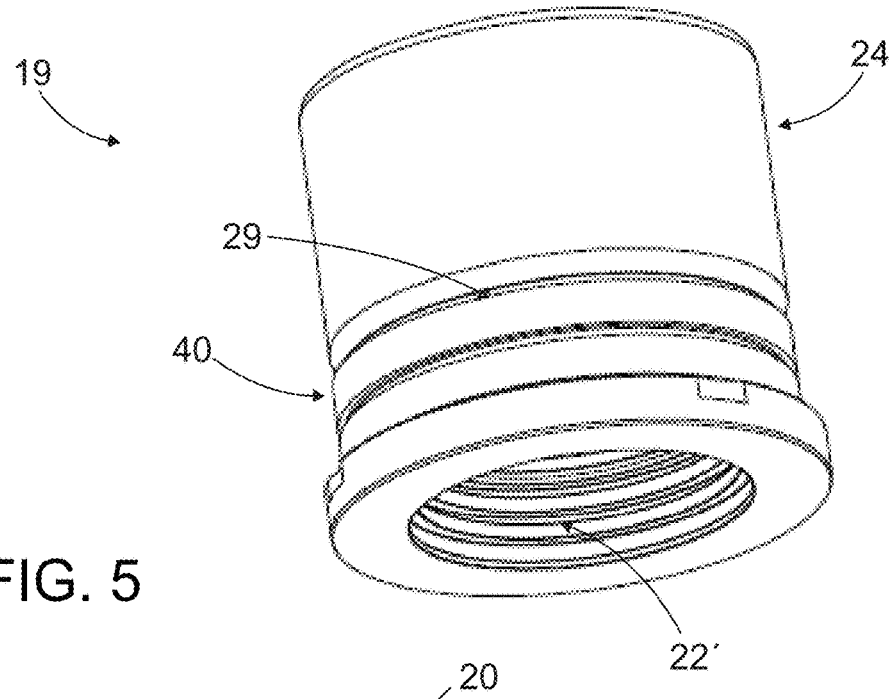
FIG. 5 is a schematic view of a first piston bearing bushing mountable at a tool side end of a percussion device.

FIG. 5 discloses a first piston bearing element 19 which is in accordance with the one shown in FIG. 2. Inside the element 19 are sealing housings 22' for the hydraulic seals and on an outer surface is a sealing groove 40 for an outer sealing element.

The first and second piston bearing elements 19, 20 can be preassembled by providing them with the sealing elements. Mounting the sealing elements to separate bushings is much easier than mounting them to a complete percussion device structure.

Figure 6:
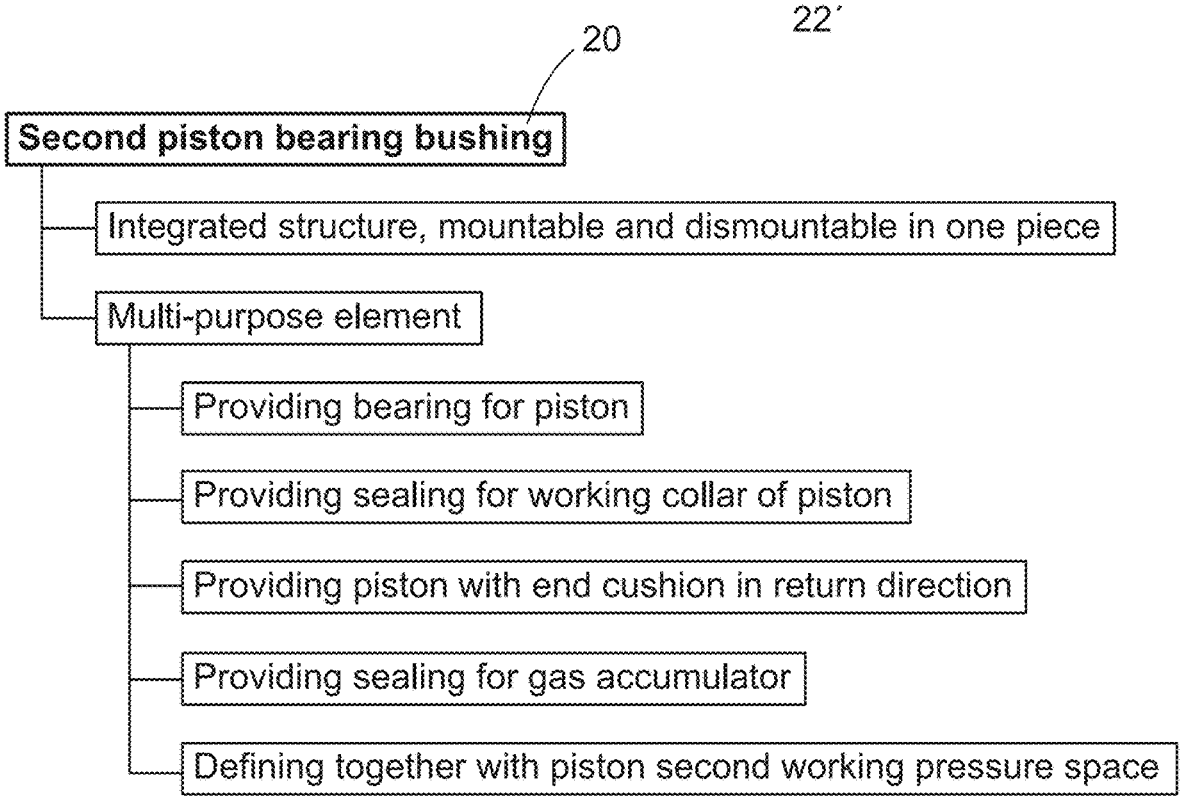
FIG. 6 is a schematic view of a diagram showing some issues and features relating to the disclosed second piston bearing bushing.

Features disclosed in FIG. 6 have already been discussed supra.

Figure 7:
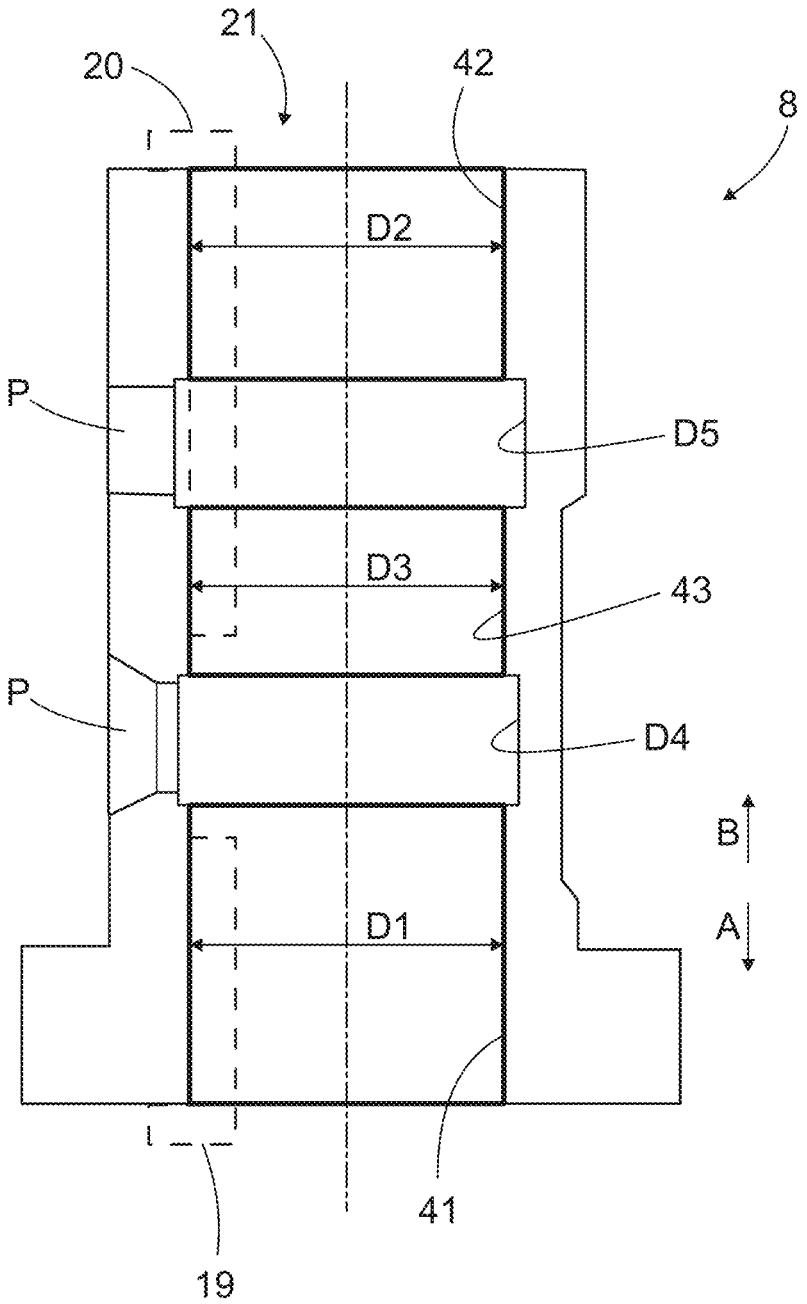
FIG. 7 is a schematic and sectional side view of a frame of a percussion device.

FIG. 7 discloses an elongated sleeve-like frame 8 of a percussion device comprising a central opening 21 provided with inner coaxial inner diameters D1, D2 having equal dimension. The dimension of the diameters D1, D2 match with equal outer diameter of a first and second piston elements 19, 20. Thus, bearing bushings 41 and 42 for receiving the bearing bushings 19, 20 have equal diameter. Further, at a middle section of the frame may be a third section 43 configured to receive a lower end portion of the bushing 20. Inner diameter D3 of the third section 43 may also have the same diameters as diameters D1, D2 at the ends. All the diameters D1, D2, D3 are also coaxial. Between accurate sections 41, 42, 43 there may be non-machined sections serving as chambers for pressure connections P. As can be seen, the structure of the frame 8 is relatively simple and easy to manufacture.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A hydraulic breaking hammer, comprising:

a percussion device including a frame and a piston arranged inside the frame, the percussion device being configured to perform a working cycle including reciprocating longitudinal movement of the piston in an impact direction and a return direction due to pressure of hydraulic fluid fed to first and second working pressure spaces of the percussion device;

at least one control device is arranged for controlling feeding and discharging of the hydraulic fluid of at least one of the first and second pressure spaces for executing the working cycle;

a working collar of the piston located between the first and second working pressure spaces and wherein an outer surface of the working collar is sealed to surrounding structures so that the first and second working pressure spaces are hydraulically separated; and a first piston bearing and a second piston bearing located at an axial distance from each other, wherein the first and second piston bearings are configured to provide support for opposite first and second end portions of the piston, whereby the first working pressure space, the working collar and the second working pressure space are all located between the first and second piston bearings, the second piston bearing being a separate sleeve-like second piston bearing element mountable to the frame in one piece, wherein a radial clearance is disposed between the outer surface of working collar and the second piston bearing element and at least one separate collar sealing element being arranged to seal the radial clearance, and wherein the second piston bearing element includes at least one first sealing housing for the at least one separate collar sealing element.

2. The breaking hammer as claimed in claim 1, wherein the first sealing housing is located at a tool side end portion of the second piston bearing element and includes a sealing groove on an inner surface of the second piston bearing element, the separate collar sealing element being a slide ring mounted to the sealing groove.

3. The breaking hammer as claimed in claim 1, wherein the second piston bearing element is provided with a dedicated lubrication channel.

4. The breaking hammer as claimed in claim 1, wherein the second piston bearing element is provided with an end cushion space which is configured to form a closed pressure space together with the working collar when the longitudinal movement in the return direction exceeds a predetermined dead point where the longitudinal movement of the piston changes between the return and impact directions.

5. The breaking hammer as claimed in claim 1, wherein the first and second piston bearings are both replaceable and elongated bearing bushings.

6. The breaking hammer as claimed in claim 1, wherein the percussion device includes a direct acting pressure accumulator which is located at a return direction end of the piston and is configured to store pressure energy when the second end portion of the piston protrudes inside the direct acting pressure accumulator during the longitudinal movement of the piston in the return direction, the second piston bearing element being provided with at least one second sealing housing at the second end portion facing towards the direct acting pressure accumulator, and wherein the second sealing housing is provided with a gas sealing element facing towards the piston and separating a bearing portion of the second piston bearing element and the direct acting pressure accumulator in a fluid tight manner from each other.

7. The breaking hammer as claimed in claim 1, wherein the second working pressure space, which is located at a side of the return direction, is limited only by the piston and the second piston bearing element.

8. The breaking hammer as claimed in claim 1, wherein the first and second piston bearings are both replaceable and elongated bearing bushings and wherein magnitudes of outer diameters of the replaceable and elongated bearing bushings facing radially to the frame are equal, the frame of the percussion device having a central through opening, both end portions of the central through opening having coaxial inner diameters a magnitude of which are equal and match the magnitudes of the equal outer diameters of the replaceable and elongated bearing bushings.

9. The breaking hammer as claimed in claim 1, wherein the control device is configured to direct substantially constant hydraulic fluid pressure to the first working pressure space for moving the piston in the return direction and wherein the control device is further configured to feed and discharge hydraulic fluid pressure to and from the second working pressure space and to thereby control reciprocating movement of the piston during the work cycle.

10. A method of supporting a piston of a hydraulic breaking hammer, the method comprising:

supporting the piston axially movably relative to a frame of a percussion device of the breaking hammer by means of a first piston bearing and a second piston bearing;

sealing working pressure spaces of the percussion device from each other by means of a sealing element which is located at a working collar of the piston;

arranging the first piston bearing at an impact direction side end portion of the piston and the second piston bearing at an opposite returning direction side end portion of the piston;

using a separate sleeve-like bearing bushing for the second piston bearing element;

providing the second piston sealing bushing with a first sealing housing facing towards the piston;

mounting a changeable collar sealing element to the first sealing housing; and mounting the second piston bearing bushing together with the changeable collar sealing element to the frame of the percussion device such that the second piston bearing bushing and the changeable collar sealing element are one piece, wherein the second piston bearing element provides bearing and sealing for the piston.

* * * * *